United States Patent [19]

Van Rensburg et al.

[11] Patent Number: 4,805,415

[45] Date of Patent: Feb. 21, 1989

[54] MINE COOLING

[75] Inventors: Carl S. J. Van Rensburg, Alberton; Johannes Van Der Walt, Roodepoort, both of South Africa

[73] Assignee: General Mining Union Corporation Limited, South Africa

[21] Appl. No.: 44,488

[22] Filed: Apr. 16, 1987

[30] Foreign Application Priority Data

Apr. 22, 1986 [ZA] South Africa ..... 86/3001

[51] Int. Cl.[4] ..... F25D 23/12

[52] U.S. Cl. ..... 62/260; 62/498

[58] Field of Search ..... 62/260; 98/50; 165/45

[56] References Cited

FOREIGN PATENT DOCUMENTS 2631754 1/1978 Fed. Rep. of Germany ..... 62/260

605578 7/1948 United Kingdom ..... 62/260

*Primary Examiner*—Henry A. Bennet

*Attorney, Agent, or Firm*—Pasquale A. Razzano

[57] ABSTRACT

A subterranean excavation such as a mine working is cooled by a refrigeration plant having a heat rejection system at an upper station and a heat absorption system in the excavation, the refrigerant medium being ammonia. The system includes a surge drum at the upper station and maybe also at the excavation. Safety measures include the location of the vapor and liquid pipes in a borehole separate from the mine shaft or shafts.

9 Claims, 2 Drawing Sheets

MINE COOLING

FIELD OF THE INVENTION

This invention relates to the cooling of subterranean excavations. The invention is particuarly applicable to and has been developed for mine workings where cooling is required to provide an acceptable working environment, and, in what follows, the invention will be discussed in relation to them; but its utility extends to other subterranean sites such as nuclear waste repositories.

BACKGROUND OF THE INVENTION

Historically, deep level mines are commonly cooled by chilled water which is fed gravitationally into the mine, generally through a plurality of pressure drop or energy recovery stations, and again pumped in stages from the mine to the surface. The capital and operating costs involved in pumping energy, pumps, dams, power recovery turbines, large diameter thick-walled piping, in gravitationally braking and pumping the water at a rate of as much as 1.6 tons/second and enormous, particularly in mines as deep as 3000 m or more, where virgin rock temperatures may be between 30 and even up to 90 deg.C. and contribute significantly to mining costs.

A more recent and efficient cooling method consists in feeding ice into the mine in place of chilled water. This method has a advantage over the former methods in that the ice is fed at terminal velocity into the mine through relatively low-pressure piping to suitable ice-water exchangers, but still suffers the disadvantages associated with having to pump water from the mine.

OBJECT OF THE INVENTION

It is the object of this invention to provide an underground cooling method in which the above disadvantages of known methods and systems are much minimised.

THE INVENTION

According to the invention, a method of cooling a subterranean excavation of the order of 1000 meters or more below ground level includes the steps of forming a loop comprising the excavation and a station of the order of 1000 meters or more above it; condensing a refrigerant vapour at the station, feeding the refrigerated vapour into the loop, expanding it within the excavation, and returning the expanded vapour to the station for re-condensing.

The station would, in all but exceptional cases, be located at surface level, where heat generated in condensing the vapour can be harmlessly rejected.

Further according to the invention, the refrigerant vapour is ammonia, for reasons which will emerge later.

THE DRAWINGS

The invention will be described by way of example only with reference to the drawings, in which.

DESCRIPTION OF THE ILLUSTRATED EMBODIMENTS

Figure 1:
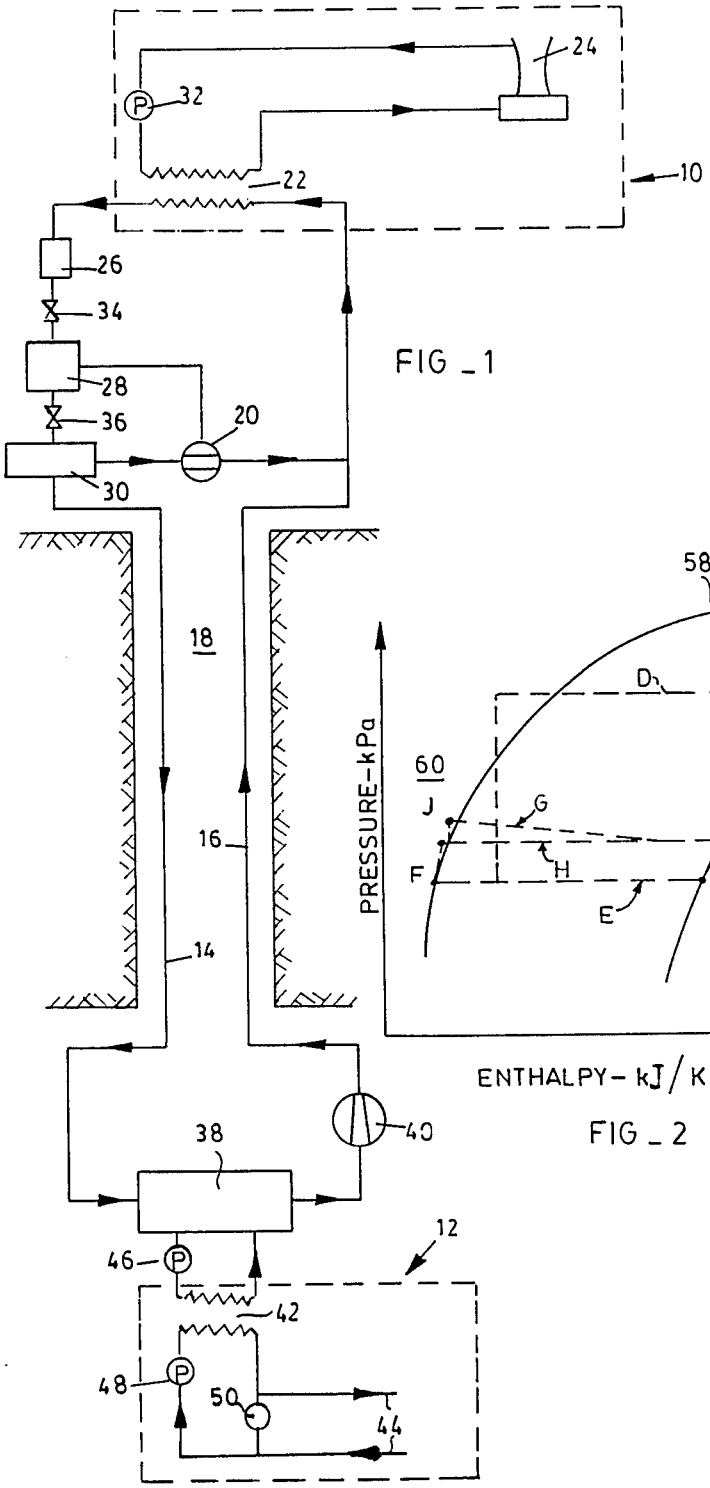
FIG. 1 is a schematic diagram of a basic plant for exercising the process of the invention.

FIG. 1 of the drawing shows a refrigeration loop which includes a heat rejection system defined by the dotted-line block 10 which is located at a station on surface; a heat absorption system defined by the dotted-line block 12 which is located underground in the mine working to be cooled, and a refrigerant circuit comprising two refrigerant carrying pipes 14 and 16 which interconnect the station and the working through a shaft 18, one, 14, being a down, or liquid, pipe and the other 16 an up, or vapour, pipe. The pipes may be located within a bratticed-off portion of a downcast shaft 18; but preferably, for safety reasons which will be discussed later, in a borehole that is distinct and isolated from a mine shaft.

The heat rejection system 10 includes a compressor 20, a condenser 22, and a cooling tower 24 or any other means to reject heat. The surface station also includes a receiver 26, an optional economiser 28, a surge drum 30, and all the other components found in a typical refrigeration plant, such as a pump 32, and an expansion valve 34 between the receiver 26 and the economiser 28, and an expansion valve 36 between the economiser and the surge drum 30.

The surge drum 30 may be at surface or underground; or there may be a surge drum at the surface station and one underground, as is seen in FIG. 1 at 30 and 38.

A compressor 40 may be included underground in the refrigeration circuit, in association with the underground surge drum 38. This compressor receives the expanded vapour from the heat-absorption circuit 12, and the compressed vapour is transported up the vapour pipe 16 back to the surface compressor 20.

The compressor 40 could be located at the surface or dispensed with, but its presence has the important advantages over a surface compressor that a smaller diameter vapour pipe can be used and that total compressor power is reduced, resulting in considerable savings in capital and running costs.

The heat absorption system comprises an evaporator 42, the normal cooling water circuit 44, a pump 46 and the compressor 40.

Apart from the pipes 14,16, the refrigeration circuit comprises the underground surge drum 38, a pump 48 and an optional temperature control valve 50.

In operation, the refrigerant vapour is compressed and fed to the condenser 22 and thence to the economiser 28, if there be one.

Midway through the compression phase, vapour from the economiser circuit is fed back interstage to the compressor 20 from the surge drum 30, resulting in an effective two-stage refrigeration cycle.

The superheated, compressed vapour passing to the condenser 22 is liquefied and sub-cooled. The liquid then flows to the economiser 28, if present, and the surface cycle is repeated.

If no economiser is provided, the vapour flows directly from the receiver 26 to the surge drum 30.

The vapour stream enters the surge drum 30 through the expansion valve 34 which causes partial vaporisation.

The flow of vapour is from the surge drum 30 to the compressor 20. The flow of liquid is from the surge drum 30 down the liquid pipe 14 into the surge drum 38, through the pump 46, through the evaporator 42, back to the surge drum 38, through the compressor 40, up the vapour pipe 16 and so back to the condenser 22. The cycle is completed.

The drawing and above description of it are obviously simplistic and the sytem in practice could include, in both the heat rejection and absorption systems, booster and scavanger compressors and the like to provide a more power-efficient system in which the gravitational effects on the refrigerant in the pipes 14 and 16 could be balanced.

The refrigerant used is ammonia because of its high latent heat of vaporisation and high vapour density. These two properties of ammonia as a refrigerant make possible the use of relatively low liquid volume and mass and so smallest practical flow rates, pipe and compressor sizes. Also, because ammonia is non-corrosive to steel, the rust problem inherent in the use of water and ice systems is avoided.

Because of the use of potentially dangerous ammonia as a refrigerant, if the shaft 18 be used to accommodate the pipes 14,16, it must be an upcast shaft and the heat absorption portion of the system must be close to the base of the shaft, so that ammonia which may accidentally leak from the system at the working place will be drawn through the shaft out of the mine workings.

Owing to their small diameters, the pipes 14,16 can be located within a bratticed-off portion of an upcast ventilation shaft. Leaks from the pipes will be entrained in the upcast air in the shaft.

As an additional safety factor, if the escape of vapour is more than the up-draught can cope with, the mine design should include provision for scouring the affected site by short-circuiting downcast air and blasting a large volume of air through the affected working place and up the shaft 18.

However, even those precautions may not satisfy mine safety regulations. By far the most desirable configuration, therefore, is for the pipes to be housed in a borehole independent of the normal mine shafts. Since the pipes are of small diameter, even for mines of 4000 meters or more, a borehole of one meter in diameter will suffice to contain them. The underground plant will be located close to the bottom of the borehole, and means will be provided for scouring the working site, as mentioned above.

Extensive comparisons have been carried out, to determine the relative efficiencies, capital and running costs of cooling systems making use of water, water with energy recovery (ER), ice, water vapour, ammonia vapour and vapour of the refrigerant R12 (or dichlorol difluorol methane).

Table I illustrates by way of comparative example the efficacy of the system and method of the invention over known systems, namely, cooling by cold water, by cold water in an energy recovery (ER) system, by ice, by water vapour, ammonia and by R12 vapour.

TABLE I

| | | 100 MW(R) AT A DEPTH OF 3 km | | | | | |
|---|---|---|---|---|---|---|---|
| | | 1 | 2 | 3 | 4 | 5 | 6 |
| A COOLING METHOD | | Water at 0,5° C. | 0,5° Water with ER | Ice at 0° C. | Water Vapour at 0° C. | Amonia Vapour at −2° C. | R12 Vapour at −2° C. |
| B Specific Cooling | kJ/kg | 85,79 | 112,21 | 421,38 | 2 471,45 | 1 240,8 | 118,62 |
| | kJ/m³ | 85 788 | 112 207 | 421 381 | 11,99 | 3 989,7 | 2 339,3 |
| C Specific pumping power (at evaporating press.) | kJ/kg | 39,14 | 14,19 | 39,14 | 39,14 | 39,14 | 39,14 |
| | kJ/m² | 39 140 | 14 188 | 39 140 | 0,1899 | 125,85 | 771,99 |
| D Pumping power per unit of cooling | kJ(P)/kJ(R) | 0,4562 | 0,1264 | 0,0929 | 0,0158 | 0,0315 | 0,330 |
| E Liquid to be circulated (at evaporating press.) | kg/s | 1 166 | 891 | 237,31 | 40,46 | 80,59 | 843,03 |
| | m³/s | 1,166 | 0,891 | 0,2373 | 8 339 | 25,06 | 16 627,7 |
| F Diameter of pumping column (Evaporating pressure) | | 900 HP | 750 HP | 400 HP | 23 000 LP | 750 LP | 32 000 LP |
| (after compression) | | | | | 16 000 LP | 550 LP | 23 000 LP |
| Diameter of supply column (after condensation) | | 300 LP | 750 HP | 400 LP | 75 LP | 150 LP | 250 LP |
| G TYPICAL NUMBER OF PUMP STATIONS | | | | | | | |
| Descending fluid | | Nil | 2 or 3 | Nil | Nil | Nil | Nil |
| Ascending fluid | | 2 or 3 | 2 or 3 | 2 or 3 | Nil or 1 | Nil or 1 | Nil or 1 |
| H Typical Temperature of chilled water °C. for underground use | | 9,5° C. | 1,5° C. | 0° C. | 0° C. | 0,5° C. | 0,5° C. |

MW(R) = Mega Watts of refrigeration
ER = Energy recovery system
HP = High pressure
LP = Low pressure In Table I, each column of the table is based on obtaining 100 megawatts of refrigeration (MW(R)) at a mine depth of 3000 meters.

Columns 1 to 3 of the table are typical of surface mine refrigeration installations which are currently in common use. In column 1, chilled water is fed directly into the mine at terminal velocity without energy recovery; in column 2 the chilled input water is braked by energy recovery stations; and in column 3 crushed ice is fed directly into the mine where the latent heat of fusion of water is employed for cooling working places.

In column 3 the specific and latent heat of fusion of water as well as a potential temperature rise of 25° C. of the melted ice have been taken into account as is the frictional energy gain of the descending ice.

Columns 4 to 6 are situations in which the latent heat of vaporisation minus the frictional energy gain of descending liquefied refrigerants are employed.

Row A in the table depicts the method of cooling.

Row B is the specific cooling capacity of the various substances used for cooling a mine and is, as far as columns 1 and 2 are concerned, a function of the specific heat of water and the frictional energy pain associated with descending water as well as the effect of energy recovery systems (column 2) combined with a potential temperature rise in water temperature of about 24.5 deg.C. The row B Figures are expressed in both kJ/kg and kJ/m³ at the row A temperatures.

Row C illustrates the specific pumping power minus any energy that could be recovered (column 2), expressed in both kJ/kg and kJ/m$^3$ of fluid that is circulated. This pumping power is only that component of the pumping power that is required to overcome the gravitional forces which are typically 95% to 98% of the total pumping power employed in conventional primary mine cooling circuits.

The Figures of row D are obtained by dividing the first line of Figures of row C with the first line of Figures of row B to obtain the pumping power per unit of cooling which is expressed in either kJ(pumping)/kJ(cooling) or kW(pumping)/kW(cooling). From these Figures it is apparent that the water vapour (column 4) requires the lowest pumping power per unit of cooling and that ammonia (column 5) comes second with ice and water following.

Row E illustrates the amount of liquid to be circulated to achieve 100 MW of cooling and is expressed in both kg/s and m$^3$/s. In the case of columns 1 to 3 the volume, (m$^3$) is that of the liquid, and, in the case of columns 3 to 6, that of the saturated vapour at the row A temperatures. From row E it is learned that the water vapour system (column 4) requires the least liquid to be circulated, with ammonia (column 5) again followed second by ice, the refrigerant R12, the energy recovery water system of column 2 and the column 1 system. If the volumn flow rates are now considered, it is learned that the volumn flow rate of ice is the lowest of the conventional methods and that of ammonia the lowest of the methods employing water vapour or refrigerants.

Applying typical design velocities to the liquid volumes of row E in order of magnitude of equivalent pipe, pump or compression suction size, the Figures in lines 1 and 2 of row E are arrived at for ascending and descending fluids. In columns 4 to 6, line 1 depicts the pipe pump or conpressor suction sizes for vapoureous refrigerants in an uncompressed state i.e., the saturation temperatures given in row A. In line 2 the Figures are those obtained when the vapoureous fluids are compressed to typical condensing temperatures. From lines 1 and 2 it is again apparent that the ice of column 3 requires the smallest diameter pumping column and ammonia the second smallest. However a large difference between the two systems is that the ammonia pipe 16 is a low pressure pipe with no pump stations and that the column 3 water return pipe is a high pressure pipe with two or three pump stations. Line 3 of row F shows typical pipe sizes for descending fluids, from which it is seen that the water vapour system of column 4 requires the smallest diameter pipe, followed by ammonia and R12. Again no energy recovery stations are required in the ammonia pipe 14.

Row G shows a typical number of pump and energy recovery stations that are required in a particular system. In the case of the column 4, 5 and 6 systems underground compressors are regarded as pump stations.

Row H illustrates the typical temperatures at which each of the systems could provide underground cooling water.

From the above observations, ignoring the column 4 water vapour system for the moment, it is clear that the ammonia system would be the most economical and practical of all the compared systems for deep mines, for the following reasons:

(a) Its pumping cost is low by comparison;
(b) The diameter of pipes that are required is small by comparison;
(c) The pressure rating of the pipes are low by comparison with those in existing systems;
(d) The least number of positive displacement compressors are required;
(e) At most, the equivalent of one pump station is required;
(f) No energy recovery stations are required;
(g) No water dams are required;
(h) Double or multi-stage cooling can be accommodated which makes the refrigeration cycle more power-efficient.

The water vapour system, while, on paper, offering some advantage, is not practical for the following two major reasons:

(a) The system needs to operate under a high vacuum and will consequently require large "by volume" compressors;

(b) The ascending vapour pipes are impractically large in diameter.

Calculations have been made to compare the parameters of six cooling systems, namely water, water with energy recovery (ER), ice, water vapour, ammonia and R12 refrigerant, at depths of 1, 2, 3 and 4 kms. The figures for a depth of 3 km are tabulated in Table I.

Calculations were then made on the respective capital and power costs at the various depths. The results are seen in Tables II, III, IV and V and demonstrate the superiority of the ammonia system over the compared systems.

In parenthesis, it is pointed out that no comparisons have been made for excavations less than 1000 meters in depth, for the reason that no serious heat-dissipating problems are normally encountered so shallowly. It is for this reason that the claims of this patent are confined to systems for use at depths of the order of 1000 meters or more, say from 750 meters upwards.

It is accepted practice (and was followed in this study) that refrigeration capacity for a surface installation should be about 20 kW(R) per kg/s of dry air, and the water flow rate should not be less than 0.06 l/s per kW(R). For underground installations, the figures are respectively 30 and 40 kW(R), the water flow rate being the same as for surface installations.

Evaluation of the data in Tables II to V shows that:

The relative capital costs of the systems at various depths, are, in the order ice and water, with the ammonia system at a base of 100 and using the figures at the upper limits of the ranges of costs:

for 1 km, 300 and 190;
for 2 km, 300 and 240;
for 3 km, 300 and 275; and
for 4 km, 312 and 287.

Power consumption for the systems are, ammonia again at a base of 100:

for 1 km, 197 and 117;
for 2 km, 189 and 120;
for 3 km, 198 and 141, and
for 4 km, 177 and 150.

TABLE II

CAPITAL AND POWER COST ESTIMATES FOR 25 MW(R) AT A DEPTH OF 1 KM

CAPITAL COST ($US M)

| | Ammonia System FIG. II | Ice System FIG. III | Water System FIG. IV |
|---|---|---|---|
| Refrigeration (Ice) plant with evap. and cond. in Titanium - excluding heat rejection system, secondary cooling water circuit, shaft piping, buildings, foundations and excavations | 3 to 3,75 M | 10 to 12,5 M | 3 to 3,75 M |
| Shaft piping and support | ,75 to 1 M | ,75 to 1 M | 2,25 to 3 M |
| Energy Recovery System | — | — | 1 to 1,25 M |
| Pumping System | — | 0,5 to 0,75 M | 0,75 to 1 M |
| Total Plant Cost | 3,75 to 4,75 M | 11,25 to 14,25 M | 7 to 9 M |

These capital cost estimates include the design, supply and installation of mechanicals, piping, electricals and instrumentation hardware and some supporting steelwork but no civils, excavations, structurals and no safety measures for the Ammonia system.

POWER CONSUMPTION

| | | | |
|---|---|---|---|
| Refrigeration Plant kW(E) | 3 980 | 7 000 | 3 050 |
| Pre-cooling tower kW(E) | — | 75 | 400 |
| Pumping power kW(E) | — | 750 | 3 250 |
| Energy recovery kW(E) | — | — | (2 050) |
| Total Power Consumption kW(E) | 3 980 | 7 825 | 4 650 |
| Total Power Cost at $1 740/kW(E) | 6,95 M | 13,7 M | 8,15 M |

These power costs exclude the power associated with the condenser cooling circuit and the secondary cooling water circuit.

TABLE III

CAPITAL AND POWER COST ESTIMATES FOR 50 MW(R) AT A DEPTH OF 2 KM

CAPITAL COST ($US M)

| | Ammonia System FIG. II | Ice System FIG. III | Water System FIG. IV |
|---|---|---|---|
| Refrigeration (Ice) plant with evap. and cond. in Titanium - excluding heat rejection system, secondary cooling water circuit, shaft piping, buildings, foundations and excavations | 6,25 to 7,5 M | 20 to 25 M | 6,25 to 7,5 M |
| Shaft piping and support | 2 to 2,25 M | 2,5 to 3,25 M | 6,25 to 8,75 M |
| Energy Recovery System | — | — | 3,5 to 4,25 M |
| Pumping System | — | 1,25 to 1,5 M | 2,5 to 3,5 M |
| Total Plant Cost | 8,25 to 10 M | 25,75 to 29,75 M | 18,5 to 24 M |

These capital cost estimates include the design, supply and installation of mechanicals, piping, electricals and instrumentation hardware and some supporting steelwork but no civils, excavations, structurals and no safety measures for the Ammonia system.

POWER CONSUMPTION

| | | | |
|---|---|---|---|
| Refrigeration Plant kW(E) | 9 300 | 14 300 | 6 200 |
| Pre-cooling tower kW(E) | — | 150 | 600 |
| Pumping power kW(E) | — | 3 100 | 13 300 |
| Energy recovery kW(E) | — | — | (8 450) |
| Total Power Consumption kW(E) | 9 300 | 17 550 | 11 650 |
| Total Power Cost at $1 740/kW(E) | 16,25 M | 30,7 M | 20,4 M |

These power costs exclude the power associated with the condenser cooling circuit and the secondary cooling water circuit.

TABLE IV

CAPITAL AND POWER COST ESTIMATES FOR 100 MW(R) AT A DEPTH OF 3 KM

CAPITAL COST ($US M)

| | Ammonia System FIG. II | Ice System FIG. III | Water System FIG. IV |
|---|---|---|---|
| Refrigeration (Ice) plant with evap. and cond. in Titanium - excluding heat rejection system, secondary cooling water circuit, shaft piping, buildings, foundations and excavations | 12,5 to 15 M | 40 to 50 M | 12,5 to 15 M |
| Shaft piping and support | 3,75 to 5 M | 5 to 6,25 M | 12,5 to 17,5 M |
| Energy Recovery System | — | — | 10 to 12,5 M |
| Pumping System | — | 3,75 to 5 M | 7,5 to 10 M |
| Total Plant Cost | 16,25 to 20 M | 48,75 to 61,25 M | 42,5 to 55 M |

These capital cost estimates include the design, supply and installation of mechanicals, piping, electricals and instrumentation hardware and some supporting steelwork but no civils, excavations, structurals and no safety measures for the Ammonia system.

POWER CONSUMPTION

| | | | |
|---|---|---|---|
| Refrigeration Plant kW(E) | 19 750 | 29 300 | 12 200 |
| Pre-cooling tower kW(E) | — | 300 | 1 300 |
| Pumping power kW(E) | — | 9 500 | 39 800 |

TABLE IV-continued

CAPITAL AND POWER COST ESTIMATES FOR 100 MW(R) AT A DEPTH OF 3 KM
CAPITAL COST ($US M)

| | Ammonia System FIG. II | Ice System FIG. III | Water System FIG. IV |
|---|---|---|---|
| Energy recovery kW(E) | — | — | (25 400) |
| Total Power Consumption kW(E) | 19 750 | 39 100 | 27 900 |
| Total Power Cost at $1 740/kW(E) | 34,55 M | 68,4 M | 48,8 M |

These power costs exclude the power associated with the condenser cooling circiuit and the secondary cooling water circuit.

TABLE V

CAPITAL AND POWER COST ESTIMATES FOR 200 MW(R) AT A DEPTH OF 4 KM
CAPITAL COST ($US M)

| | Ammonia System FIG. II | Ice System FIG. III | Water System FIG. IV |
|---|---|---|---|
| Refrigeration (Ice) plant with evap. and cond. in Titanium - excluding heat rejection system, secondary cooling water circuit, shaft piping, buildings, foundations and excavations | 25 to 30 M | 80 to 100 M | 25 to 30 M |
| Shaft piping and support | 7,5 to 10 M | 10 to 12,5 M | 25 to 30 M |
| Energy Recovery System | — | — | 25 to 30 M |
| Pumping System | — | 10 to 12,5 M | 20 to 25 M |
| Total Plant Cost | 32,5 to 40 M | 100 to 125 M | 95 to 115 M |

These capital cost estimates include the design, supply and installation of mechanicals, piping, electricals and instrumentation hardware and some supporting steelwork but no civils, excavations, structurals and no safety measures for the Ammonia system.

| POWER CONSUMPTION | | | |
|---|---|---|---|
| Refrigeration Plant kW(E) | 44 750 | 54 680 | 24 850 |
| Pre-cooling tower kW(E) | — | 600 | 2 600 |
| Pumping power kW(E) | — | 23 820 | 108 390 |
| Energy recovery kW(E) | — | — | (69 100) |
| Total Power Consumption kW(E) | 44 750 | 79 100 | 66 740 |
| Total Power Cost at $1 740/kW(E) | 78,3 M | 138,45 M | 116,8 M |

These power costs exclude the power associated with the condenser cooling circiuit and the secondary cooling water circuit.

In Tables VI, VII, VIII and IX, the operating costs of the three systems at depths of 1, 2, 3 and 4 kms, to produce respectively 25, 50, 100 and 200 MW(R) (megawatts of refrigeration)) are contrasted. The savings effected are considerable, increasing as the depth increases.

TABLE VI

25 MW(R) AT 1 000 M DEPTH

| | $NH_3$ | $H_{20}$ | ICE |
|---|---|---|---|
| Fluid flow rate kg/s | 19,7 | 249 | 58,4 |
| Fluid pumping head kPa | 85 | 9 785 | 9 785 |
| Refrigeration plant power kW(E) | 3 980 | 3 050 | 7 000 |
| Pre-cooling, tower power kW(E) | — | 400 | 75 |
| Pumping power kW(E) | Incld | 3 250 | 750 |
| Energy Recovery kW(E) | — | (2 050) | — |
| Total Power | 3 980 | 4 650 | 7 825 |
| Difference with $NH_3$ kW(E) | — | $1,2 M | $6,75 M |

TABLE VII

50 MW(R) AT 2 000 M DEPTH

| | $NH_3$ | $H_{20}$ | ICE |
|---|---|---|---|
| Fluid flow rate kg/s | 39,4 | 508 | 119 |
| Fluid pumping head kPa | 333 | 19 570 | 19 570 |
| Refrigeration plant power kW(E) | 9 300 | 6 200 | 14 300 |
| Pre-cooling, tower power kW(E) | — | 600 | 150 |
| Pumping power kW(E) | Incld | 13 300 | 3 100 |
| Energy Recovery kW(E) | — | (8 450) | — |
| Total Power | 9 300 | 11 650 | 17 550 |

TABLE VII-continued

50 MW(R) AT 2 000 M DEPTH

| | $NH_3$ | $H_{20}$ | ICE |
|---|---|---|---|
| Difference with $NH_3$ kW(E) | — | $4,1 M | $14,95 M |

TABLE VIII

100 MW(R) AT 3 000 M DEPTH

| | $NH_3$ | $H_{20}$ | ICE |
|---|---|---|---|
| Fluid flow rate kg/s | 78,8 | 1 016 | 245 |
| Fluid pumping head kPa | 500 | 29 350 | 29 350 |
| Refrigeration plant power kW(E) | 19 750 | 12 200 | 29 300 |
| Pre-cooling, tower power kW(E) | — | 1 300 | 300 |
| Pumping power kW(E) | Incld | 39 800 | 9 500 |
| Energy Recovery kW(E) | — | (25 400) | — |
| Total Power | 19 750 | 8 150 | 19 350 |
| Difference with $NH_3$ kW(E) | — | $14,25 M | $33,85 M |

TABLE IX

200 MW(R) AT 4 000 M DEPTH

| | $NH_3$ | $H_{20}$ | ICE |
|---|---|---|---|
| Fluid flow rate kg/s | 157 | 2 077 | 456 |
| Fluid pumping head kPa | 666 | 39 140 | 39 140 |
| Refrigeration plant power kW(E) | 44 750 | 24 850 | 54 680 |
| Pre-cooling, tower power kW(E) | — | 2 600 | 600 |
| Pumping power kW(E) | Incld | 108 390 | 23 820 |
| Energy Recovery kW(E) | — | (69 100) | — |
| Total Power | 44 750 | 66 740 | 79 100 |

TABLE IX-continued

| 200 MW(R) AT 4 000 M DEPTH | | | |
|---|---|---|---|
| | $NH_3$ | $H_{20}$ | ICE |
| Difference with $NH_3$ kW(E) | — | $38,50 M | $60,1 M |

As a specific example of the system of the invention, for a typical layout as envisaged in FIG. 1 for cooling a mine working 3 km deep and using ammonia as refrigerant, there follow figures relating to the cooling plant.

Summer conditions:

Wet bulb temperature: 18 deg.C.
Refrigeration capacity: 102.3 MW(R)
Total plant capacity: 100 MW(R)
Compressor power consumption: 19.75 MW(E)
Total power consumption: 19.75 MW(E).

Net cooling C O P=5.06
Down-pipe (insulated) diameter: 150 mm.
Up-pipe (uninsulated)-dimeter: 600 mm.
Power of compressor 20: 2100 kW(E)
Power of compressor 40: 17,650 kW(E).
Condenser temperature: 28 deg.C.
NH3 temperature leaving condenser: 23 deg.C.
Temperature of liquid entering down-pipe: −9 deg.C.
Rate of flow of liquid in down-pipe: 78.8 kg/second.
Temperature at bottom of down-pipe: −2 deg.C.
Pressure of liquid at bottom of down-pipe: 400 kPa.
Capacity of surge drum 38: 100 $m^3$.
Saturation temperature of liquid leaving surge drum 30: −2 deg.C.
Pressure of liquid leaving surge drum 38: 400 kPa.
Temperature of vapour leaving compressor 40: 41 deg.C.
Pressure of vapour leaving compressor 40: 600 kPa.
Rate of flow of vapour in up-pipe: 78.8 kg/second.
Saturation temperature of vapour at top of up-pipe: 28 deg.C.
Pressure of vapour at top of up-pipe: 1100 kPa.
Condenser water circuit:

Temperature of water ingoing to condenser: 20.5 deg.C.
Temperature of water leaving condenser: 25.5 deg.C.
Rate of flow through circuit: 5830 l/second.

Evaporator water circuit:

Temperature of water ingoing to evaporator: 25 deg.C.
Temperature of water leaving evaporator: 0.5 deg.C.
Rate of flow of water in circuit: 975 l/second.

Notes:

Downgoing liquid is set near terminal velocity.
Friction losses in up-pipe=250 kPa.
Up-pipe static head=250 kPa
Refrigerant charge, 50 tons=75 $m^3$ (liquid)
Power consumption of the heat rejection and evaporator cooling water circuits have been excluded.

Figure 2:
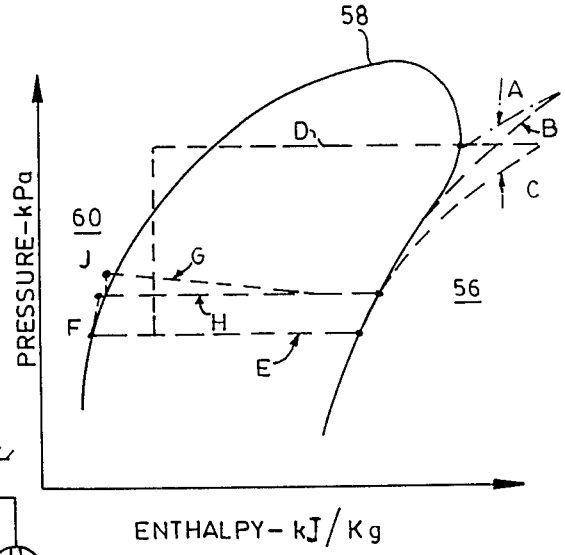
FIG. 2 is a pressure-enthalpy diagram indicating the enthalpies obtaining in the components of the system.

In the pressure-enthalpy diagram shown in FIG. 2, the enthalpy of refrigerant within the various components of the system are shown as follows:

Line A—refrigerant in vapour phase in the up-pipe 16, in the vapour zone 56 of the diagram.
Line B—refrigerant vapour phase after compression in the underground compressor 40.
Line C—refrigerant in liquid phase, in the surface compressor 20.
Line D—refrigerant in the condenser 22, initially in vapour phase, then in mixed liquid-vapour phase within the interior of the dome 58, and in liquid phase in the sub-cooled zone 60, then partially re-vaporised when expanded.
Line E—refrigerant in the surface surge drum 28.
Line F—refrigerant in the down-pipe, in liquid phase in the zone 60.
Line G—refrigerant in the evaporator 44 passing from liquid, to mixed, to vapour phase.
Line H—refrigerant in the underground surge drum 30 in mixed phase, passing to the surface compressor 20 in vapour phase.
Line J—refrigerant in liquid phase in the pump 46.

An important feature of the system of the invention is that it will accommodate both increased load and reduced refrigeration capacity without sacrificing diluting water cooled temperature, that is, the distribution capacity of both the service water and the ventilation air are preserved.

Figures 3, 4:
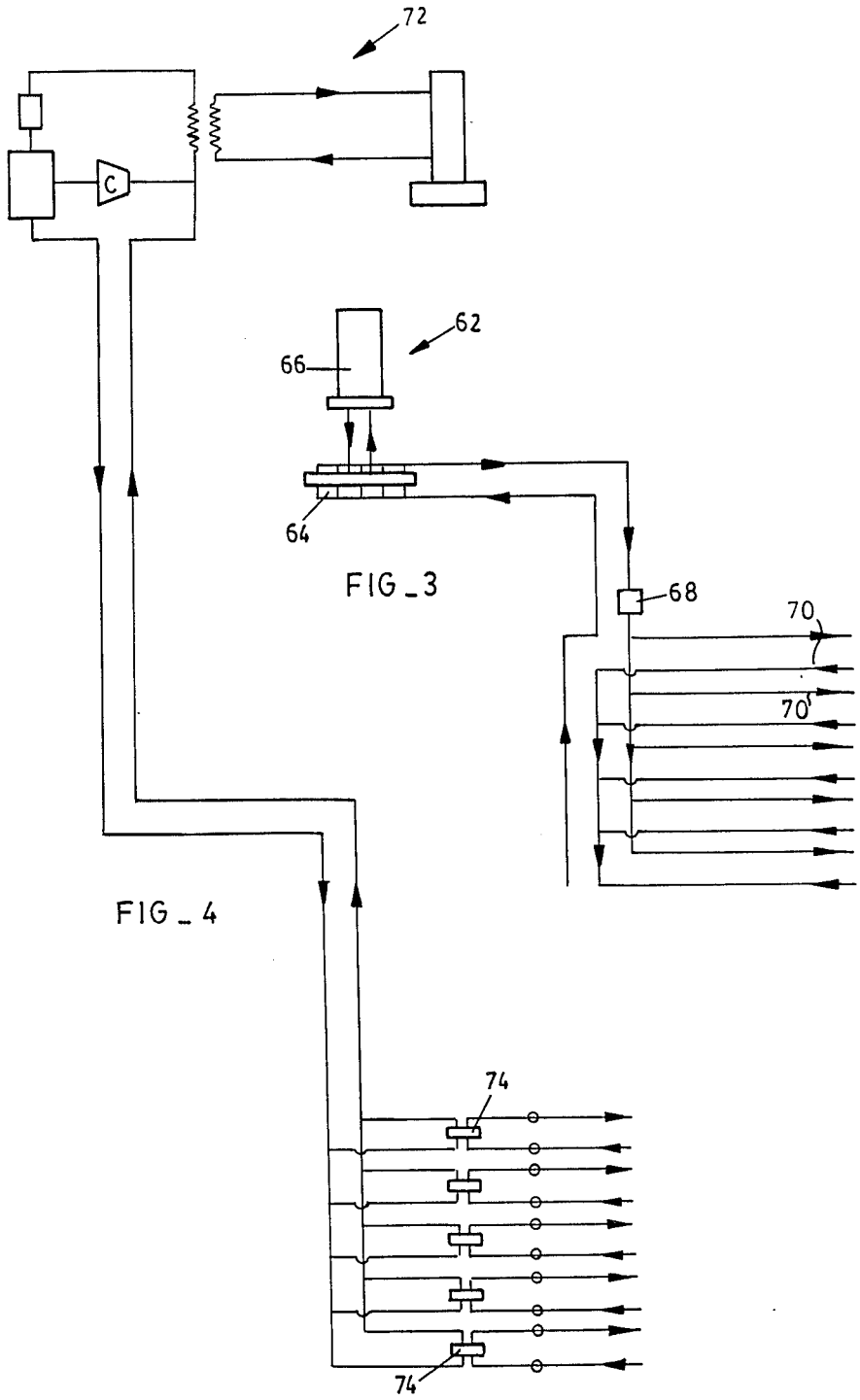
FIGS. 3 and 4 are diagrammatic representations respectively of a conventional water cooling system and a system according to the invention.

In a practical project designed for mine shaft of a total depth of 4297 meters, the basic parameters for a conventional water cooling plant and for an ammonia plant are diagrammatically illustrated in FIGS. 3 and 4.

In FIG. 3, the conventional plant consists of an underground component 62 with refrigeration machines 64 and a cooling tower 66. This component is located at a level of 2567 meters. The plant includes an energy recoverer 68, and water reticulations generally designated 70 at five levels, respectively at 3170, 3493, 3761, 4029 and 4297 meters.

The ammonia plant of FIG. 4 has the surface installation 72 as shown in FIG. 1, and underground machines 74 at the various levels.

The comparative capital and electrical energy costs are shown in Table X. It will be seen that not only is the captial cost of the cxonventional system nearly twice as much, but the savings in energy costs are even greater, namely, of the order of two and a quarter times. Thus, in one year's operation, the savings on running costs amount to some $US50 million.

It is apparent from the data set out above that the savings that can be achieved by the use of ammonia as a refrigerant vapour, compared with water and ice, are dramatic and, it is believed, totally unexpected, and the more so the deeper the mine. Savings of this order are highly significant, especially when ever-increasing costs and uncertain markets for commodities are a major preoccupation in the mining industry. Such savings will in effect mean, for marginal mines, the difference between life and death.

TABLE X

| COMPARABLE COST ELEMENTS AND ESTIMATES | | |
|---|---|---|
| | Water System | $NH^3$ System |
| Refrigeration Machines | | |
| Surface Component | — | 0,75 |
| Underground Component | 15,75 | 10,0 |
| Cooling Towers (Heat Rejection) | 6,00 | 1,2 |
| Borehole and Lining | — | 7,5 |
| Borehole or Shaft Piping | 17,5 | 8,6 |
| Vertical Pump Stations | 11,7 | 1,15 |
| Energy Recovery Stations | 3,6 | — |
| Horizontal Pump Stations | 0,75 | 0,1 |
| Safety Provisions | — | 5 |
| TOTAL: | $ 55,3 M | $ 34,3 M |
| COMPARABLE ELECTRICAL ENERGY COSTS | | |
| | kW(E) | kW(E) |
| Refrigeration Machines | | |
| Surface Component | — | 960 |
| Underground Component | 15 000 | 8 000 |
| Cooling Towers (Heat Rejection) | | |

TABLE X-continued

| | | |
|---|---|---|
| Fans | 750 | 750 |
| Pumps | 650 | 650 |
| Vertical Pump Stations | 16 350 | 1 575 |
| Energy Recovery Stations | (3 800) | — |
| Horizontal Pump Stations | — | 300 |
| TOTAL: | 28 950 | 12 250 |
| COST: | ($ 87 M) | ($ 37 M) |

We claim:

1. Apparatus to carry out the method of cooling a subterranean excavation that is of the order of 1000 meters or more below ground which consists of a compressor located at a station at least 1000 meters above a subterranean excavation to be cooled, means to feed a stream of gaseous ammonia to the compressor, a condensor at the station located to receive compressed ammonia from the compressor, an evaporator within the excavation to be cooled, an upcast ventilation shaft, a down pipe connecting the condensor to the evaporator, and an up pipe connecting the evaporator to the compressor wherein the up pipe is located concurrent within the upcast ventilation shaft.

2. Apparatus to carry out the method of cooling a subterranean excavation that is of the order of 1000 meters or more below ground which consists of a compressor located at a station at least 1000 meters above a subterranean excavation to be cooled, means to feed a stream of gaseous ammonia to the compressor, a condensor at the station located to receive compressed ammonia from the compressor, an evaporator within the excavation to be cooled, an upcast ventilation shaft, a down pipe connecting the condensor to the evaporator, and an up pipe connecting the evaporator to the compressor wherein, the evaporator is located below the upcast ventilation shaft.

3. Apparatus as claimed in claim 1, including an economiser downstream of the condenser between the condenser and the evaporator.

4. Apparatus as claimed in claim 3, including a surge drum at the station, located to receive liquefied refrigerant from the condenser.

5. Apparatus as claimed in claim 1, including surge drums at the station and at or adjacent the excavation, located to receive liquefied refrigerant from the condenser.

6. Apparatus as claimed in claim 3, including a surge drum located to receive liquefied refrigerant from the condenser, and in which the economiser is located between the condenser and the surge drum.

7. Apparatus as claimed in claim 6 including an expansion valve between the economiser and the surge drum.

8. Apparatus as claimed in claim 1, including a pipe between the economiser and the compresser.

9. Apparatus as claimed in claim 1 in which the up- and down-pipes are located in a borehole separate from the mine shaft or shafts.

* * * * *